United States Patent [19]

Kasai

[11] Patent Number: 4,999,886

[45] Date of Patent: Mar. 19, 1991

[54] PLUG AND SOCKET BUCKLE ASSEMBLY

[75] Inventor: Kazumi Kasai, Namerikawa, Japan

[73] Assignee: Yoshida Kogyo K. K., Tokyo, Japan

[21] Appl. No.: 452,046

[22] Filed: Dec. 18, 1989

[30] Foreign Application Priority Data

Dec. 19, 1988 [JP] Japan ..... 63-164223

[51] Int. Cl.[5] ..... A44B 11/26

[52] U.S. Cl. ..... 24/633; 24/640

[58] Field of Search ..... 24/633, 635, 639, 640, 24/642, 652, 653, 615, 519, 602

[56] References Cited

U.S. PATENT DOCUMENTS

| | | | |
|---|---|---|---|
| 231,048 | 8/1880 | Ives | 24/640 |
| 1,825,357 | 9/1931 | Lasselberger | 24/635 |
| 3,538,558 | 11/1970 | Croft | 24/639 |
| 4,035,877 | 7/1977 | Brownson | 24/633 |
| 4,425,689 | 1/1984 | Fildan | 24/633 |
| 4,802,262 | 2/1989 | Kasai | 24/633 |
| 4,866,819 | 9/1989 | Kasai | 24/633 |

FOREIGN PATENT DOCUMENTS

| | | | |
|---|---|---|---|
| 0046672 | 3/1982 | European Pat. Off. . | |
| 0256398 | 2/1988 | European Pat. Off. . | |
| 0390943 | 4/1989 | European Pat. Off. . | |
| 60-126010 | 8/1985 | Japan . | |
| 2099494 | 12/1982 | United Kingdom . | |
| 2150632 | 9/1985 | United Kingdom | 24/633 |

*Primary Examiner*—Victor N. Sakran

*Attorney, Agent, or Firm*—Hill, Van Santen, Steadman & Simpson

[57] ABSTRACT

A low-profile buckle includes a flat one-piece socket member molded of synthetic resin and including a top plate having a resilient locking wing engageable with locking feet of a pair of flat legs of a planar plug member to interlock the plug and socket members, and a back plate having a resilient presser flap adapted to be manually depressed to urge the resilient locking wing to resiliently flex out of engagement with the locking feet to disengage the plug and socket members.

13 Claims, 6 Drawing Sheets

PLUG AND SOCKET BUCKLE ASSEMBLY

BACKGROUND OF THE INVENTION

1. Field of the Invention

The present invention relates to a buckle for releasably connecting loose ends of a belt or strap applied to garments, bags, canteens, or the like, and more particularly to a low-profile buckle having a flat structure.

2. Description of the Prior Art

Buckles molded of synthetic resin are widely used in recent years because they can be manufactured at a low cost. The molded synthetic resin buckles are however made relatively thick and bulky so as to withstand forces applied thereto during the use of an article to which the buckle is attached.

The recent trend of the buckles is towards a thinner or low-profile design. One such low-profile buckle is disclosed in Japanese Utility Model Laid-open Publication No. 60-126010. The disclosed buckle is made of metal and comprises of a male member including a pair of locking legs having locking steps at their distal ends, and a female member composed of a base member having a belt retaining portion, front and back plates covering the opposite sides of the base member, and a resilient member having a resilient locking piece releasably engageable with the locking step of the male member. The back plate has a presser piece adapted to be depressed by the user's finger to unlock the locking legs of the male member and the resilient member of the female member.

Since the female member is composed of four component parts assembled together, i.e. the base, the front plate, the back plate and the resilient member, the prior low-profile buckle requires a complicated and time-consuming assembling process and hence is costly to manufacture.

SUMMARY OF THE INVENTION

With the foregoing difficulties in view, it is an object of the present invention to provide a buckle which is low in profile and does not deteriorate the aesthetical appearance of an article to which the buckle is attached, has a sufficient strength comparable to the metal buckles, and is capable of dispensing the need for a complicated assembling process of a female member and hence can be manufactured at a low cost.

In brief, a buckle according to the present invention includes a flat one-piece female or socket member molded of synthetic resin and including a top plate having a resilient locking wing engageable with locking feet of a pair of legs of a male or plug member to interlock the socket and plug members, and a back plate having a resilient presser flap adapted to be manually depressed to urge the resilient locking wing out of engagement with the locking feet to disengage the socket and plug members.

More particularly, according to the present invention, there is provided a buckle comprising: a planar plug member including a pair of laterally spaced flat legs having a pair of looking feet projecting from one surface of the respective flat legs; and a flat one-piece socket member molded of synthetic resin and including a top plate and a back plate defining therebetween a guide channel for receiving therein the flat legs of the plug member, the top plate including a resilient locking wing projecting into the guide channel and engageable with the locking feet to interlock the plug member and the socket member, the back plate including a resilient presser flap resiliently flexible toward the resilient locking wing to urge the latter to move outwardly of the guide channel for bringing the locking wing and the locking feet out of engagement with one another.

With this construction, when the plug and socket members of the buckle are to be coupled, the legs of the plug member are inserted into the guide channel of the socket member. As the legs are forced to advance, the locking feet of the respective legs engage the resilient locking wing of the socket member and then cause the resilient locking wing to flex outwardly of the guide channel. A further advancing movement of the legs causes the locking feet to move past the resilient locking wing whereupon the resilient locking wing is enabled to spring back into its initial position to lock the locking feet, thereby coupling the socket and plug members of the buckle. To disengage the socket and plug members, the resilient presser flap is depressed by the user's finger to cause the resilient locking wing to resiliently flex outwardly of the guide channel so that the locking feet are released from interlocking engagement with the locking wing. The plug member is thus allowed to be released from the socket member.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
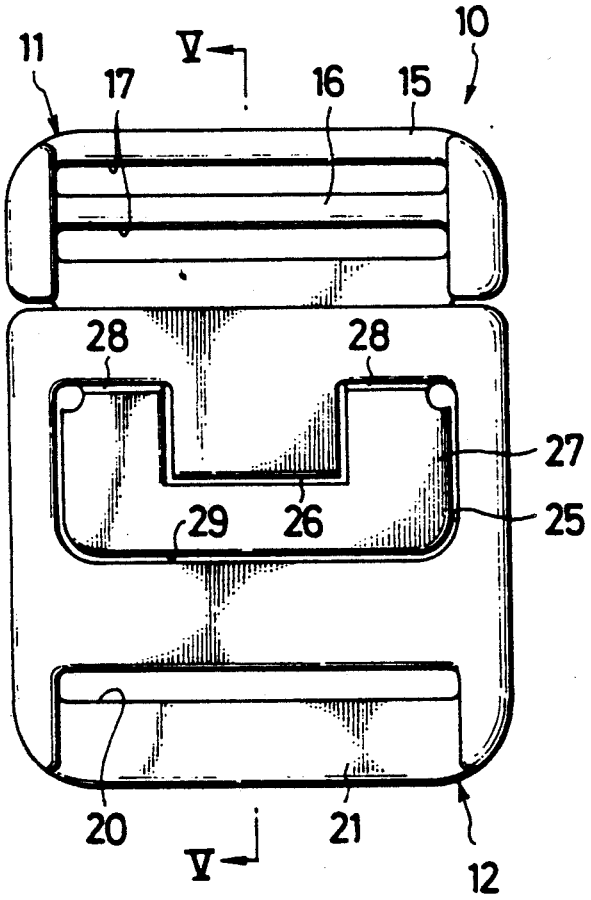
FIG. 1 is a front elevational view of a buckle according to the present invention.
Figure 2:
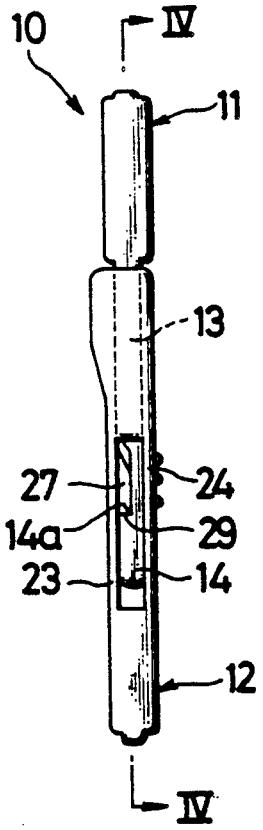
FIG. 2 is a right side view of FIG. 1.
Figure 3:
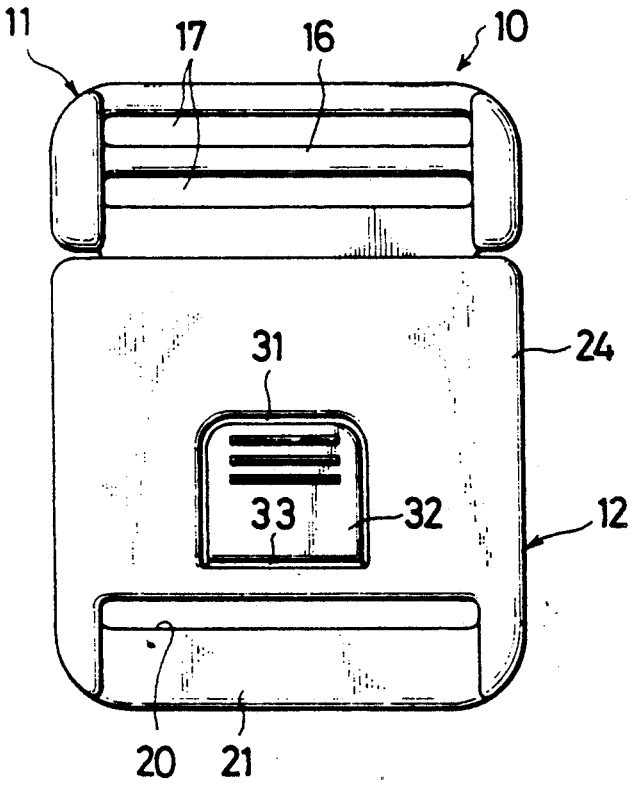
FIG. 3 is a rear view of FIG. 1.

Referring to the drawings, wherein like reference characters designate like or corresponding parts throughout the several views, FIG. 1 shows a buckle 10 embodying the present invention. The buckle 10 comprises a male or plug member 11 and a female or socket member 12 releasably coupled with the plug member 11.

Figure 5:
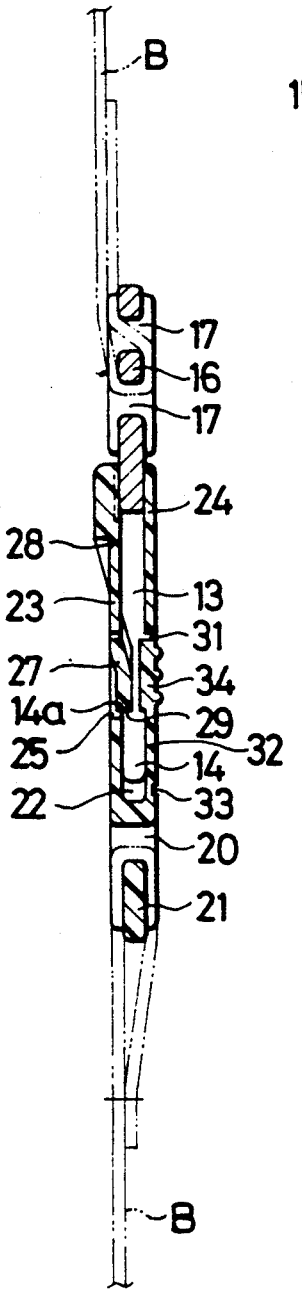
FIG. 5 a cross-sectional view taken along line V—V of FIG. 1.
Figure 6:
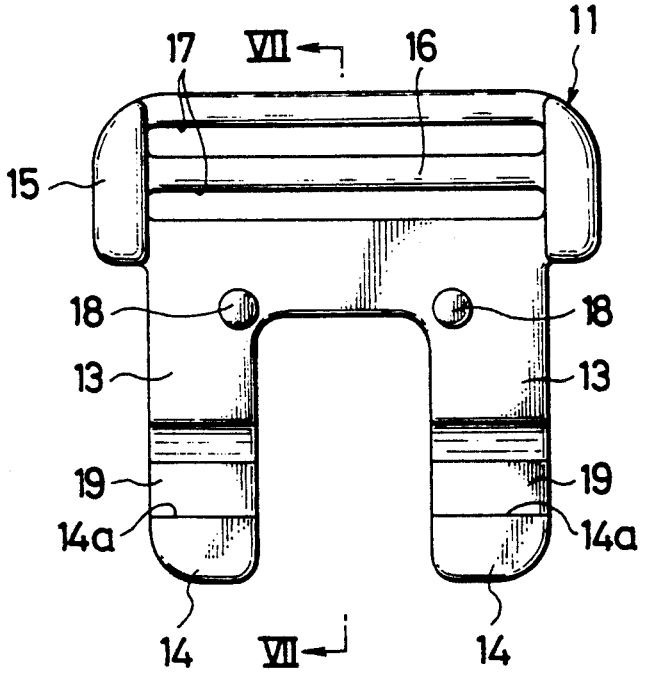
FIG. 6 is a front elevational view of a male or plug member which constitutes one part of the buckle shown in FIG. 1.
Figure 7:
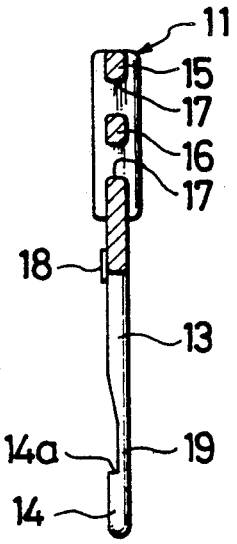
FIG. 7 is a cross-sectional view taken along line VII—VII of FIG. 6.

The plug member 11, as shown in FIGS. 6 and 7, includes a pair of laterally spaced flat legs 13, 13 extending from one end of a flat hollow connector frame 15 of a rectangular shape and having a pair of locking feet 14, 14, respectively, projecting from one surface of the respective legs 13. The hollow connector frame 15 is adapted to be connected to an end portion of a strap or belt B (FIG. 5) and includes a central crossbar 16 around which the belt end portion is looped. The connector frame 15 further has a pair of transverse guide grooves 17 extending along opposite side edges of the crossbar 16 for the passage of the belt end portion. A pair of guide projections 18, 18 is disposed on one surface of the connector frame 15 adjacent to respective proximal ends of the legs 13 for a purpose described later. The guide projections 18 are disposed on a same side of the plug member 11 as the locking feet 14. The legs 13 have respective ankles 19 of a reduced thickness adjacent to the locking feet 14. With the thin ankles 19 thus provided, the locking feet 14 have a thickness same as the maximum thickness of the legs 13, as shown in FIG. 6. The locking feet 14 have a pair of abutment surfaces 14*a*, respectively, facing toward the proximal ends of the respective legs 13. The plug member 11 in the illustrated embodiment is made of metal, however, it may be formed of synthetic resin provided that the molded synthetic resin plug member is strong enough to withstand forces applied thereto during the use of an article to which the buckle is attached.

Figure 8:
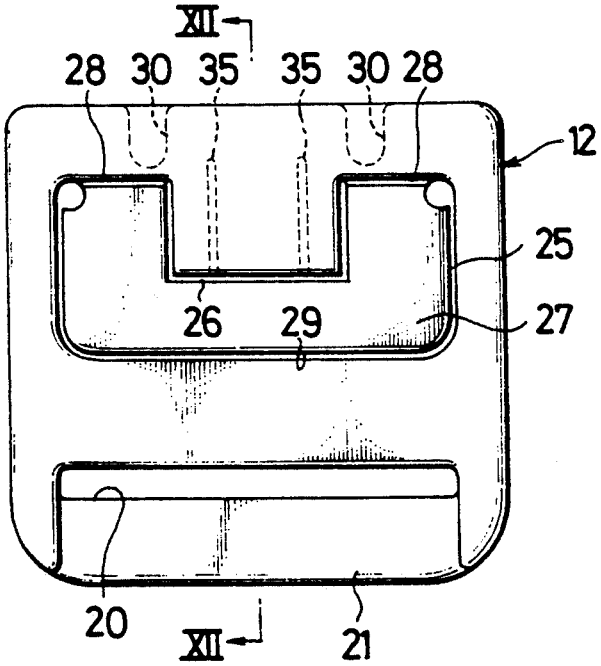
FIG. 8 a front elevational view of a female or socket member which constitutes the other part of the buckle shown in FIG. 1.
Figure 9:
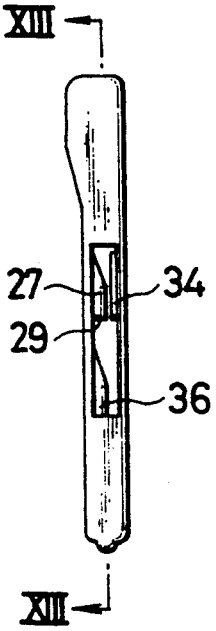
FIG. 9 is a right side view of FIG. 8.
Figure 11:
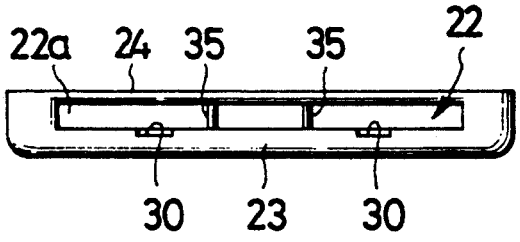
FIG. 11 is an end elevational view of FIG. 10.
Figure 12:
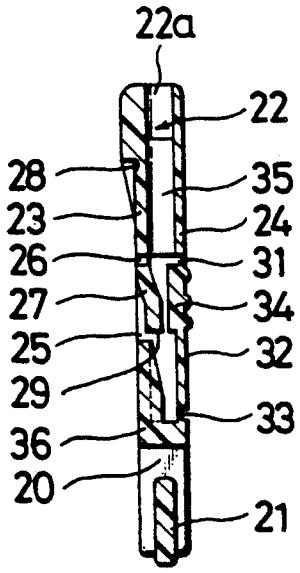
FIG. 12 is a cross-sectional view taken along line XII—XII of FIG. 8.

The socket member 12 is injection-molded of synthetic resin and includes, as shown in FIG. 8, a transverse groove 20 defined by and between a body of the socket member 12 and a transverse connector bar 21. Another end portion of the belt B (FIG. 5) is attached to the connector bar 21 with a loop extending around the connector bar 21. As shown in FIGS. 11 and 12, the body of the socket member 12 is in the shape of a flat box having a top plate 23 and a back plate 24 defining therebetween a guide channel 22 for receiving therein the legs 13 of the plug member 11. The guide channel 22 has an open end 22*a* (FIG. 12) through which the legs 13 are moved into and out of the guide channel 22. The top plate 23 has a thickness slightly larger than the thickness of the back plate 24.

The top plate 23, as shown in FIG. 8, has a U-shaped outer slot 25 and a U-shaped inner slot 26 extending parallel to one another so as to form a U-shaped resilient locking wing 27 therebetween. The top plate 23 further has in its outside surface a pair of aligned transverse recesses 28 each extending between adjacent ends of the U-shaped inner and outer slots 25, 26 to enhance the resiliency of the U-shaped resilient locking wing 27. The U-shaped resilient locking wing 27 is integrally joined at its opposite ends with the top plate 23 and extends longitudinally of the guide channel 22 with the opposite ends directed toward the open end 22*a* of the guide channel 22. The distal end of the U-shaped resilient locking wing 27 is bent or stepped inwardly so as to project into the guide channel 22 for engagement with the locking feet 14 of the plug member 11. The U-shaped resilient locking wing 27 has a transverse retaining surface 29 extending along the distal end thereof and lockingly engageable with the respective abutment surfaces 14*a* of the locking feet 14 to interlock the plug and socket members 11, 12. The top plate 23 further has in its inside surface a pair of guide recesses 30 (FIGS. 8 and 13) extending from an open end of the socket member 12 longitudinally of the guide channel 22 for snugly receiving therein the mating guide projections 18 on the plug member 11. With this combination of the guide projections 18 and the guide recesses 30, the plug member 11 and the socket member 12 can be coupled together easily and reliably without causing mismatching of the front and back sides of the plug and socket members 11, 12.

Figure 4:
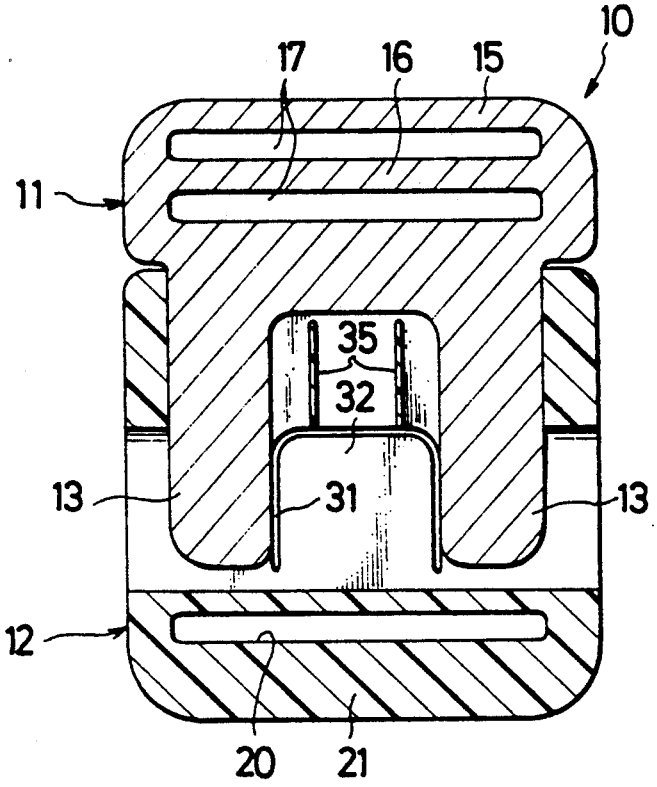
FIG. 4 is a cross-sectional view taken along line IV—IV of FIG. 2.
Figure 10:
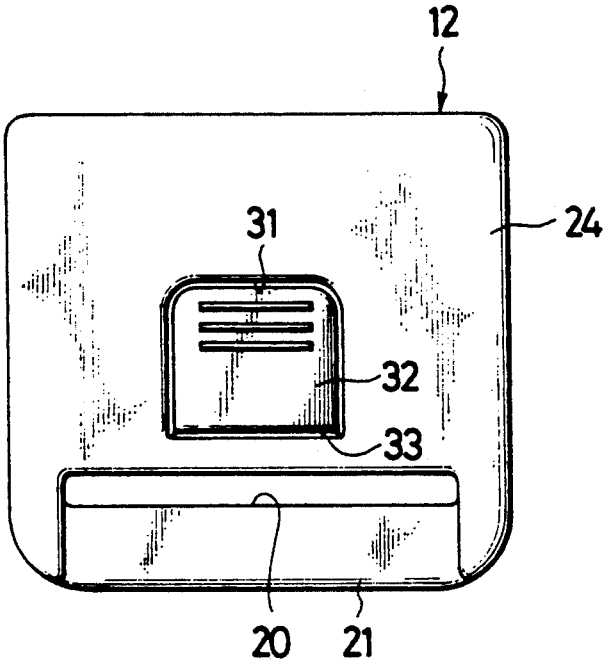
FIG. 10 is a rear view of FIG. 8.

The back plate 24, as shown in FIG. 10, has a generally inverted U-shaped slot 31 extending with its opposite ends directed away from the open end 22*a* (FIG. 5) of the guide channel 22 so as to form a substantially rectangular resilient presser flap 32 integrally joined at its proximal end with the back plate 24. The opposite ends of the U-shaped slot 31 are connected together by a transverse recess 33 extending in the outside surface of the back plate 24 for providing an enhanced resiliency to the resilient presser flap 32. The resilient presser flap 32 is disposed substantially centrally of the width of the back plate 24 and has a width smaller than the distance between the flat legs 13 of the plug member 11, as shown in FIG. 4 so that the presser flap 32 is engageable with the resilient locking wing 27 without interference with the flat legs 13 of the plug member 11 for a purpose described later. As shown in FIG. 5, the resilient presser flap 32 normally lies in a same plane as the back plate 24 and has at its distal end an enlarged presser head 34 confronting the distal end of the resilient locking wing 27 and projecting into the guide channel 22. The presser head 34 is normally separated a space from the resilient locking wing 27 and when the resilient presser flap 32 is depressed by the user's finger into the guide channel 22, the presser head 34 is brought into engagement with the resilient locking wing 27 and then urges the locking wing 27 to resiliently flex outwardly of the guide channel 22 for bringing the resilient locking wing 27 and the locking feet 14 out of locking engagement with one another.

Figure 13:
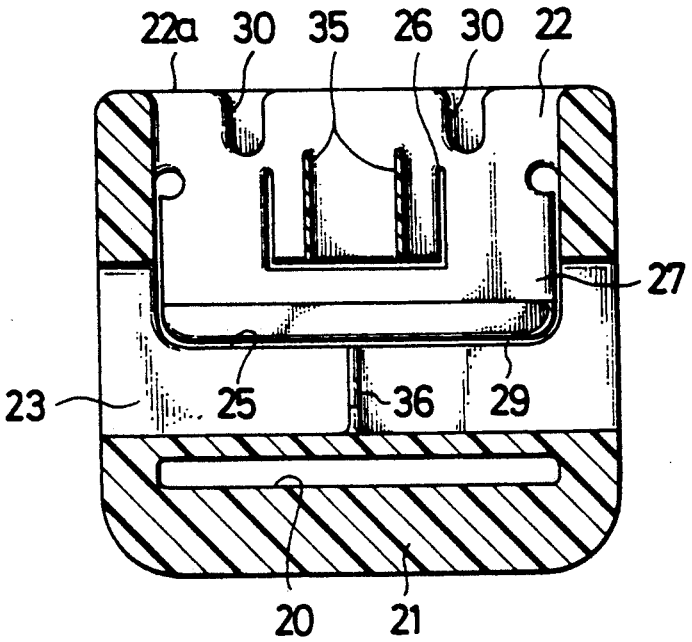
FIG. 13 a cross-sectional view taken along line XIII—XIII of FIG. 9.

The flat box-shaped socket member 12 molded of synthetic resin is considerably thinner than the conventional molded socket members. The socket member 12 has a pair of parallel spaced reinforcement walls 35 integral with the top and back plates 23, 24 and extending longitudinally of the guide channel 22. The reinforcement walls 35 are disposed inwardly of U-shaped inner slot 26 and extend from the slot 26 toward the open end 22*a* of the guide channel 22 and terminate short of the open end 22*a* as shown in FIG. 13 so as not to interfere with the connector frame 15 of the plug member 11 when the plug member 11 is coupled to the socket member 12, as illustrated in FIG. 4. The socket member 12 further has a reinforcement rib 36 integral with the top plate 23 and extending parallel to the reinforcement walls 35, as shown in FIG. 13. The reinforcement rib 36 is disposed at a closed end of the guide channel 22 and located centrally of the width of the top plate 23.

To couple the plug and socket members 11, 12 of the buckle 10 as shown in FIGS. 1 through 5, the flat legs 13 of the plug member 11 are inserted into the guide channel 22 (FIG. 5) of the socket member 12 with the locking feet 14 facing to the front side of the buckle 10. In this instance, the locking feet 14 are brought into frictional engagement with the under surface of the U-shaped resilient locking wing 27, whereupon the locking wing 27 is urged to resiliently flex outwardly of the guide channel 22. Further advancing of the flat legs 13 causes the locking feet 14 to move past the retaining surface 29 of the locking wing 27, thus enabling the locking wing 27 to spring back to its original position. In this position, the abutment surfaces 14*a* of the respective locking feet 14 are brought into engagement with the retaining surface 29 of the locking wing 27, thereby locking the plug and socket members 11, 12 in coupled condition. The advancing movement of the flat legs 14 can be achieved smoothly and accurately as the guide projections 18 (FIG. 6) of the plug member 11 are snugly received in the mating guide recesses (FIG. 13) of the socket member 12.

To disengage the plug and socket members 11, 12, the resilient presser flap 32 is pushed by the user's finger into the guide channel 22, whereupon the enlarged presser head 34 of the presser flap 32 urges the resilient locking wing 27 to resiliently flex outwardly of the guide channel 22 against the resiliency of the locking wing 27. Further pressing on the presser flap 32 causes the retaining surface 29 of the locking wing 27 to disengage from the abutment surfaces 14*a* of the locking feet 14, thus allowing the plug member 11 to be detached from the socket member 12.

The buckle 10 of the foregoing construction has many advantages: With the planar plug member 11 and the flat box-shaped socket member 12, the buckle 10 is considerably thinner than the conventional molded buckles but has a strength comparable to the relatively thick conventional molded buckles. Such a low-profile buckle matches so well with the recent fashion and does not deteriorate the aesthetical appearance of an article to which the buckle is attached. Since the socket member molded of synthetic resin has a one-piece structure and hence is capable of obviating the need for a complicated assembling work as in the conventional socket member made of metal. The molded one-piece socket member is simple in construction and can be manufactured at a low cost.

Obviously, various minor changes and modifications of the present invention are possible in the light of the above teaching. It is therefore to be understood that within the scope of the appended claims the invention may be practiced otherwise than as specifically described.

What is claimed is:

1. A buckle comprising:

(a) a planar plug member including a pair of laterally spaced flat legs having a pair of locking feet projecting from one surface of the respective flat legs; and (b) a flat one-piece socket member molded of synthetic resin and including a top plate and a back plate defining therebetween a guide channel for receiving therein said flat legs of said plug member, said top plate including a resilient locking wing integral with said top plate and projecting into said guide channel and engageable with said locking feet to interlock said plug member and said socket member, said back plate including a resilient presser flap integral with said back plate and resiliently flexible toward said resilient locking wing to urge the latter to move outwardly of said guide channel for bringing said locking wing and said locking feet out of engagement with one another.

2. A buckle according to claim 1, wherein said legs have a pair of ankles, respectively, of a reduced thickness adjacent to the respective locking feet.

3. A buckle according to claim 2, wherein said locking feet have a thickness same as the maximum thickness of said legs.

4. A buckle according to claim 1, wherein said plug further includes a connector frame from which said legs extend, and at least one guide projection disposed on one surface of said connector frame near proximal ends of the respective legs, one of said top and back plates having a guide recess sungly receptive of said guide projection.

5. A buckle according to claim 4, wherein said guide projection and said locking feet are disposed on a same side of said plug.

6. A buckle according to claim 1, wherein said resilient locking wing has a U shape, said U-shaped resilient locking wing being disposed with its opposite ends directed toward an open end of said guide channel and being integrally joined at said opposite ends to said top plate, said top plate having a U-shaped outer slot extending along an outer edge of said U-shaped resilient locking wing and a U-shaped inner slot extending along an inner edge of said U-shaped resilient locking wing.

7. A buckle according to claim 6, wherein said top plate has in its outside surface a pair of aligned recesses extending respectively between adjacent top ends of said U-shaped outer and inner slots.

8. A buckle according to claim 1, wherein said resilient presser flap is joined at its one end with said back plate and normally lies in the same plane as said back plate, said resilient presser flap having an enlarged presser head projecting from a distal end thereof into said guide channel.

9. A buckle according to claim 8, wherein said distal end of said resilient presser flap is disposed closer to an open end of said guide channel than said one end of said resilient presser flap.

10. A buckle according to claim 8, wherein said resilient presser flap has a substantially rectangular shape, said back plate having a generally U-shaped slot extending along an outer edge of said rectangular resilient presser flap.

11. A buckle according to claim 10, wherein said back plate further has in its outside surface a recess extending between opposite ends of said U-shaped slot (31).

12. A buckle according to claim 11, wherein said socket member further includes at least one reinforcement rib integral with one of said top and back plates and extending parallel to the first-mentioned reinforcement rib.

13. A buckle according to claim 1, wherein said socket member includes at least one reinforcement wall integral with said top and back plates and extending longitudinally of said guide channel.

* * * * *